United States Patent [19]

Stoody, Jr.

[11] Patent Number: 4,644,913

[45] Date of Patent: Feb. 24, 1987

[54] RECIRCULATING VALVE LASH ADJUSTER

[75] Inventor: Richard R. Stoody, Jr., New Baltimore, Mich.

[73] Assignee: Chrysler Motors Corporation, Highland Park, Mich.

[21] Appl. No.: 782,778

[22] Filed: Oct. 2, 1985

[51] Int. Cl.[4] ..... F01L 1/24

[52] U.S. Cl. ..... 123/90.46; 123/90.55

[58] Field of Search ..... 123/90.46, 90.55, 90.57, 123/90.58

[56] References Cited

U.S. PATENT DOCUMENTS

| | | | |
|---|---|---|---|
| 2,682,865 | 7/1954 | Voorhies | 123/90.55 |
| 3,605,707 | 9/1971 | Line | 123/90.57 |
| 4,228,771 | 10/1980 | Krieg | 123/90.55 |
| 4,441,465 | 4/1984 | Nakamura | 123/90.34 |
| 4,524,731 | 6/1985 | Rhoads | 123/90.55 X |

*Primary Examiner*—William R. Cline
*Assistant Examiner*—Peggy A. Neils
*Attorney, Agent, or Firm*—Kenneth H. MacLean, Jr.

[57] ABSTRACT

In an internal combustion engine with overhead valve and overhead cam type valve gear, a self-pumping hydraulic-type lash adjuster located downward from the lubricated camshaft and supplied by oil run-off from the camshaft and associated rocker arm member. The lash adjuster includes a housing with a cylindrical aperture therein in which a first plunger member is tightly slidably fitted for reciprocation forming a power chamber with the lower end of the housing. A second plunger member is relatively loosely fitted in the aperture of the housing and has a portion extending from the upper end of the housing for receiving force inputs from the rotating camshaft and associated rocker arm member. A reservoir chamber is formed by the first and second plunger members and is communicated by one-way check valve means to the power chamber to permit flow from the reservoir to the power chamber, but not otherwise. As the lobes of the camshaft produce pivotal or rocking movement of the rocker arm member, the second plunger member which supports one end of the rocker arm member is alternately cocked in a side-by-side lateral movement within the housing which movement tends to pump oil collected at the upper end of the lash adjuster housing into the reservoir chamber without the need of providing for a pressurized oil feed or passage in the engine cylinder head.

5 Claims, 7 Drawing Figures

RECIRCULATING VALVE LASH ADJUSTER

BACKGROUND AND SUMMARY OF THE INVENTION

In conventional internal combustion engines for vehicles, particularly, the valve train includes hydraulic lash adjuster means to take up the lash or operating clearance in the valve train. The hydraulic valve adjuster includes an oil filled pressure chamber which receives oil from a reservoir chamber to provide an automatically axially adjustable member taking up the aforesaid clearance space. In conventional engines, the reservoir chamber is continuously supplied with oil from a pressurized oil line which is the same oil line which lubricates the bearings of the camshaft or other valve train components. Obviously, it is costly to provide an oil passage in the cylinder head of the engine for the valve adjusters. The following list of U.S. patents disclose this conventional externally supplied lash adjuster system: U.S. Pat. Nos. 1,792,836; 2,815,012; 3,153,404; 3,352,293; 3,502,058; 4,462,364; 4,463,414; and 4,481,913.

There have been previous attempts to eliminate the external oil supply line to lash adjusters. The U.S. Pats. Nos. 4,191,142 and 4,457,270 disclose hydraulic lash adjusters with essentially sealed reservoir chambers and means in the form of a flexible diaphragm to permit volumetric changes of the oil in the reservoir to take place. Essentially, these lash adjusters are separate oil machines without any connection to the engine oiling system. However, the devices are of complicated design and they present problems over time due to leakage of oil from the reservoir despite the use of seals to prevent such leakage.

Another attempt to eliminate pressurized oil passage supply means for a lash adjuster is disclosed in U.S. Pat. No. 3,875,908. In this patent, a lash adjuster is disclosed without external pressurized oil passage means for the lash adjuster, but instead, the lash adjuster receives oil which drips from a member 3 into a central opening in the upper part of the lash adjuster. The opening or oil inlet extends axially through the upper portion or plunger of the lash adjuster and is communicated with the reservoir of the lash adjuster. Thus, the supply to the lash adjuster's reservoir depends solely on the collection of oil and the downward movement thereof by gravity to supply the reservoir. Also, the reservoir is essentially open to the interior space of the engine and, thus, not protected from contamination therein.

The subject hydraulic lash adjuster, like the device discussed in the previous paragraph, does not require the provision of an external pressurized oil line to maintain oil levels in the lash adjuster reservoir chamber. However, the subject lash adjuster utilizes a positive pumping action produced by operation of the engine to cause oil collected near the upper surface of the lash adjuster to be directed into the reservoir chamber. It has been discovered that a desirably fitted reservoir plunger within a sufficiently diametered chamber of the lash adjuster housing will be moved in a cocking or oscillating manner by the associated rocker arm which is periodically moved by the lobe of a camshaft in an overhead cam type of engine. This oscillating or cocking action of the reservoir plunger can only be achieved when the fitting between the reservoir plunger and the cylinder bore is adequate to permit this movement. This is in contrast to the very tight precision fitting of the lower power plunger of the lash adjuster which typically is in the order of a clearance of 0.00005 inches. It has been found that if the clearance between the upper reservoir plunger and the cylinder bore is about 0.002 inches, the aforementioned oscillation or side-by-side cocking of the plunger is sufficient to positively cause oil collected around the upper surface of the plunger and the housing to be pumped into the reservoir chamber in a positive manner.

Therefore, it is the object of this invention not only to eliminate the need for an external pressurized oil supply line for lash adjusters, but also to utilize the collected oil falling on top of the lash adjuster for replenishing the reservoir by means of a positive pumping action produced by the valve train of an internal combustion engine.

Further advantageous features and objects of the invention will be more readily apparent from a reading of the following Detailed Description of an Embodiment, reference being had to the accompanying drawings in which the preferred embodiment is illustrated.

IN THE DRAWINGS

DETAILED DESCRIPTION OF THE INVENTION

Figure 1:
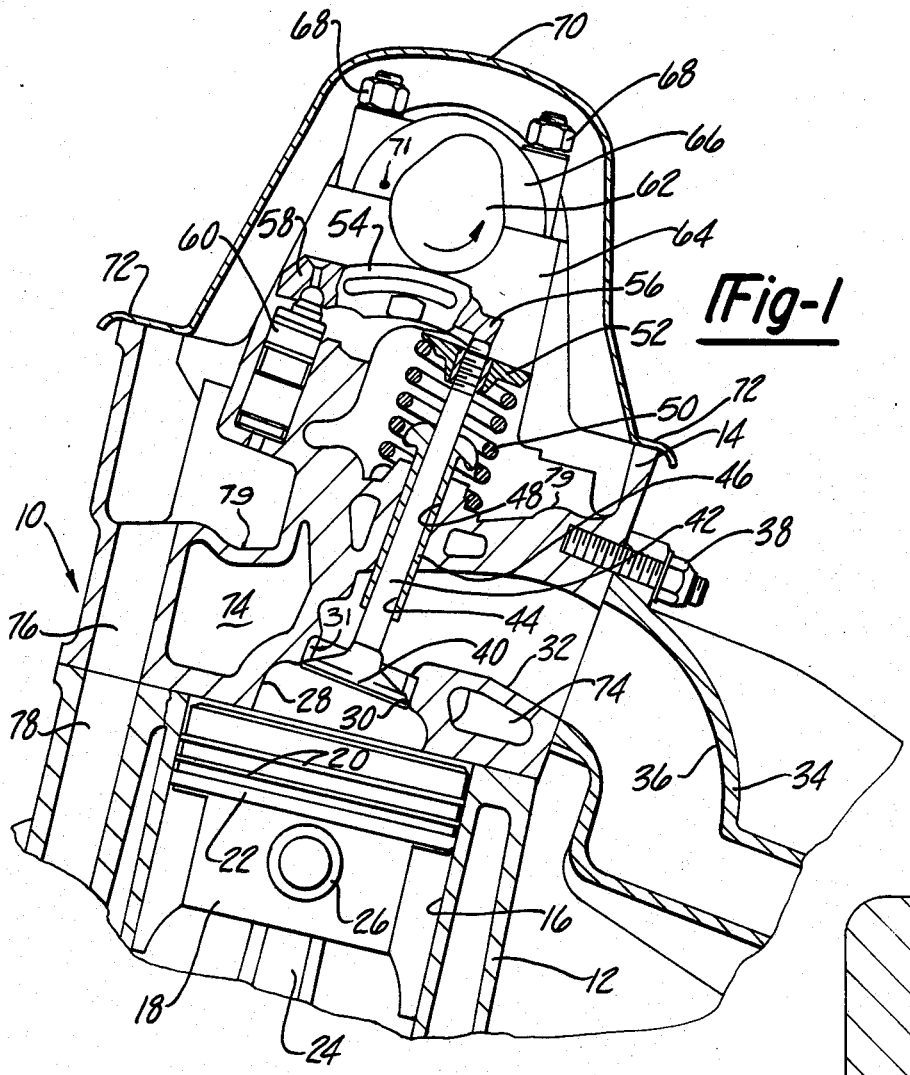
FIG. 1 is a partial sectioned elevational view of an engine block and cylinder head assembly showing the subject lash adjuster.

In FIG. 1 of the drawings, an internal combustion engine 10 is illustrated. Engine 10 includes a block member 12 (the upper part of which is shown). The block 12 is supportingly connected to a cylinder head assembly 14 containing the subject valve train and lash adjuster. The cylinder block 12 has at least one cylindrical bore 16 therein which reciprocally supports a piston 18. Piston 18 slidably moves within the bore 16 and contacts the bore by means of two piston rings 20 and an oil control ring 22 which extends circumferentially around the piston. The piston rings 20 and oil control ring 22 are effective to produce the combustion chamber above the piston in FIG. 1 as is conventional in internal combustion engines. The upper surface of the combustion chamber is defined by the lower surface of the cylinder head 14. Piston 18 is moved reciprocally and up and down in FIG. 1 within the bore 18 by a crankshaft (not shown) which is connected to the piston by means of a connecting rod 24. The upper end of the connecting rod 24 is attached to the piston by means of a wrist pin 26 normal to the elongated connecting rod 24 and extending in a radial direction with respect to the piston 18.

The combustion chamber is partially defined by the surface 28 of cylinder head 14 which forms a pocket in which two openings are formed, only one opening 30 being shown. The opening 30 is defined by the valve seat member 31 which is a hardened metal insert type device. Opening 30 extends from the combustion chamber to an exhaust passage 32. In an engine, there is also another opening to the combustion chamber communicated with an intake passage which is not shown in the drawings but is conventional in internal combustion engine design. Exhaust gases from the combustion chamber and passage 32 in the cylinder head 14 are received into the interior of an exhaust manifold 34 having an exhaust passage 36 therethrough. The exhaust manifold 34 is attached to the cylinder head 14 by means of stud and nut fasteners 38 only one of which is shown but several of which would be utilized in an actual embodiment.

The exhaust opening or port 30 is normally closed by an enlarged head portion 40 of a poppet type valve. The enlarged head portion of the valve 40 is connected to an elongated and integral stem portion 42 which is reciprocally mounted within a bore 44 of a valve stem guide member 46 which itself is pressed into a bore 48 in the cylinder head 14. The combustion chamber also includes at least one intake port or opening (not shown). This intake port would also be normally closed by an enlarged head portion of a poppet type valve in the same manner shown in FIG. 1. The intake valve, of course, would normally close off the combustion chamber from an intake passage which would be communicated with an intake manifold passage of an associated intake manifold of the engine as is conventional in engine design.

The aforesaid valves and, particularly, valve head 40 and valve stem 42 are normally held upward in FIG. 1 in the closed position by means of a coil-type valve spring 50 extending between a generally horizontal surface of the cylinder head 14 surrounding the valve guide 46 and valve retainer or keeper 52 which is secured to the upper end of the valve stem 42. As is conventional in engine design, the opening 30 is uncovered by downward movement of the enlarged head portion 40 of the valve and corresponding downward axial reciprocal movement of the stem portion 42 in the valve guide 46. This causes a retainer 52 to move downward also corresponding to axial shortening of the coil-type spring 50. The aforedescribed valve opening is produced by pivotal movement of a rocker arm member 54 and specifically downward movement of the rightward end 56 of the rocker arm against the top end of stem 42. The leftward end 58 of the rocker arm 54 is supported on the upper surface of a hydraulic lash adjuster assembly 60 and, thus, the rocker arm 54 pivots in a generally clockwise direction during valve opening. This clockwise opening pivotal movement of the rocker arm 54 is produced by engagement between the upper curved surface of the rocker arm 54 with a radially outwardly projecting lobe portion of a rotatable camshaft 62 as shown in FIG. 1. In FIG. 1, the lobe portion is pointing upward and, thus, about 180 degrees of camshaft rotation in the counter-clockwise direction according to the arrow would produce maximum downward opening of the valve stem 42 and connected head portion 40 thereof.

The camshaft 62 is supported in FIG. 1 by an upwardly directed boss portion 64 of the cylinder head 14. The boss portion 64 defines a semi-cylindrical bearing surface in which the journal (behind the lobe portion 62 visible in FIG. 1) would rotate. The other half of the bearing for the camshaft journal is provided by a bearing cap member 66 also having a semi-cylindrical bearing portion therein cooperative with the bearing portion in the cylinder head 14 to provide 360 degrees of bearing for the camshaft journal. The bearing cap 66 is securely clamped to the cylinder head 14 by means of stud and nut fasteners 68, two of which are shown in FIG. 1. In an actual four cylinder engine, for example, the camshaft would include two end bearing portions and bearing portion similar to that shown in FIG. 1 between cylinders 1 and 2, between cylinders 2 and 3, and between cylinders 3 and 4. Lastly, the valve train previously described is covered by a valve cover member 70 with outwardly turned edge portions 72 contacting the cylinder head 14 and fastened thereto by fastener means (not shown).

In conventional engine design, the camshaft 62 and specifically the lobes thereon which engage the upper surface of the rocker arms 54 are provided with a supply of lubricating oil by oil passage means within the cylinder head 14 and the bearing caps 66. An example of a method utilized to oil cam lobes in the Chrysler 2.2 liter four cylinder engine is found in U.S. Pat. No. 4,258,673. This patent lubricates the cam lobes by providing orifice 71 in the bearing cap 66 for squirting oil therefrom onto the cam lobe prior to contact with the upper surface of the rocker arm 54. Thus, oil is carried by the cam lobe along the upper surface of the rocker arm 54 and resultantly, a considerable quantity of oil is deposited on the upper curved surface of the rocker arm member 54 and specifically, a quantity of this oil will flow over the upper surface of the leftward end 58 of the rocker arm 54. Resultantly, there is a considerable quantity of oil which flows around the rocker arm and onto the top surfaces of the lash adjuster 60.

The cylinder head 14 also includes a plurality of interconnected water cooling passages or cavities 74 therein as in conventional internal combustion engine design. Obviously, these cavities 74 are separated from other internal spaces within the engine which transmit air, fuel, exhaust or oil. Also shown in FIG. 1 is an oil return and crankcase vent passage provided by aligned passages 76 in the cylinder head 14 and 78 in the cylinder block 12. Oil, after lubricating the valve train components, drops by gravity to the floor or upper surface 79 of the valve train cavity defined by the cylinder head 14. The oil flows about the boss 64 and portion supporting the valve stem guide 46 to the opening of passage 76 and, hence, downward through passages 76 and 78 to the crankshaft.

Figure 2:
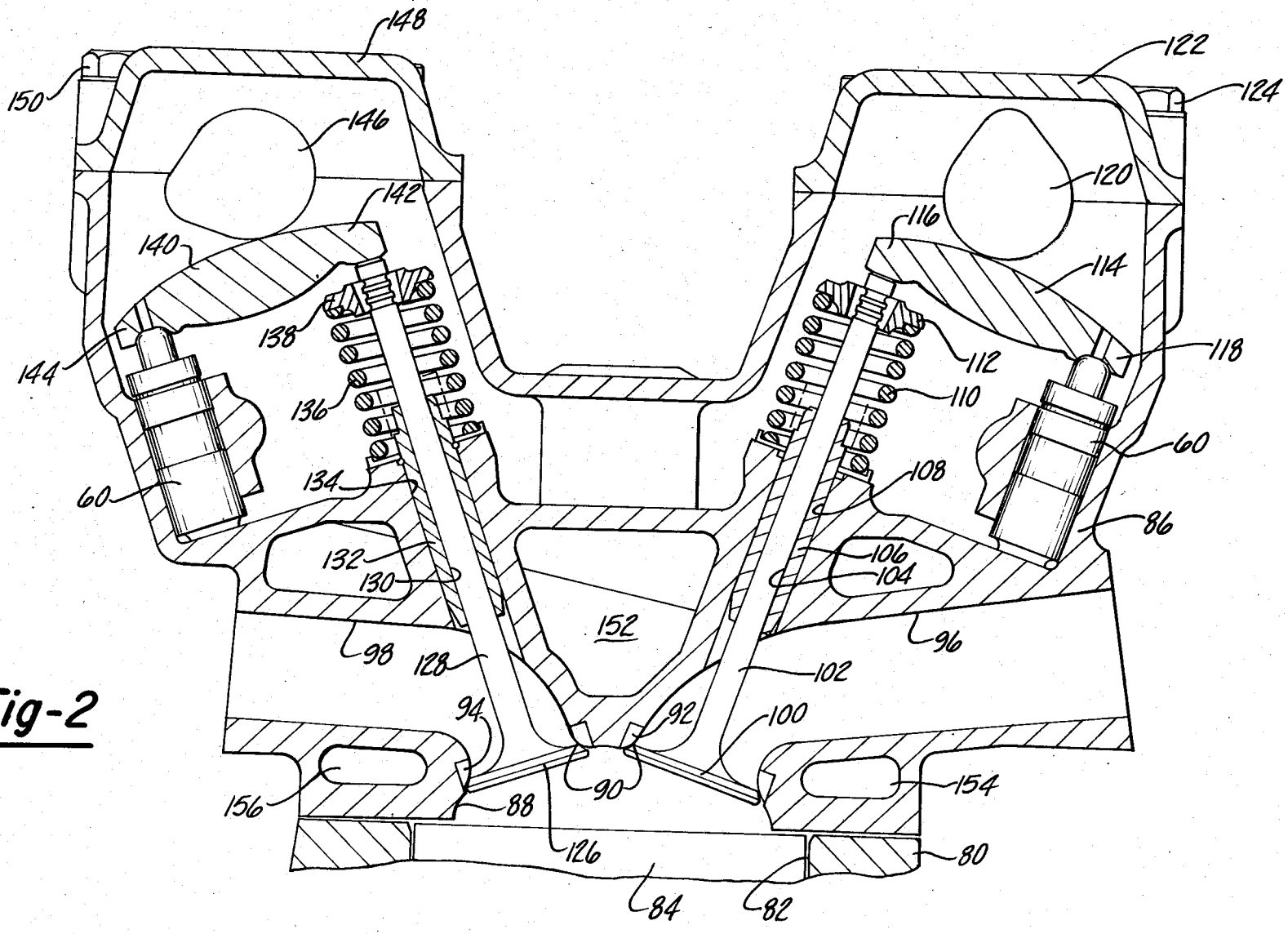
FIG. 2 is a sectioned elevational view similar to FIG. 1 showing the subject lash adjuster in a dual overhead cam-type engine.

Another engine embodiment is shown in FIG. 2 which utilizes the subject lash adjuster 60. Specifically, a part of the cylinder block 80 is shown which is essentially the same as the cylinder block 12 in FIG. 1 since it includes at least one cylinder bore 82 in which a piston 84 is reciprocally mounted. However, the cylinder head member 86 is different in configuration so as to support two overhead camshafts and thereby permit intake and exhaust valves to be placed in the same plane of FIG. 2. In fact, the dual overhead cam arrangement is particularly well suited for providing an engine with two intake and two exhaust valves per each combustion chamber.

The cylinder head 86 defines an enlarged valve pocket forming surface 88 which supports dual openings 90 therethrough, one for an exhaust opening located to the left in FIG. 2 and one an intake opening located to the right in FIG. 2. Openings 90 are defined by and encircled by annular valve seat rings 92 and 94 similar to the member 31. These valve seat members 92 and 94 are of hard metal. The hard metal rings 92 and 94 are necessary because typically the cylinder head 86, as well as cylinder head 14 in FIG. 1, are typically cast or molded of soft metal material such as aluminum for weight saving and heat transfer purposes. The rightward opening 90 in FIG. 2 is communicated with an intake passage means 96 in the cylinder head 86. The leftward opening 90 in the cylinder head 86 is communicated with an exhaust passage 98.

The rightward opening 90 is normally covered by the enlarged head portion 100 of an intake valve having an elongate stem portion 102 integrally attached to the head portion 100. The stem portion 102 is reciprocally and slidably received within a bore 104 of a valve stem guide member 106 which itself is press-fit into a bore 108 in the cylinder head 86. The enlarged head portion 100 of the valve is maintained in the closed position shown in FIG. 2 by means of the coil type spring 100 which bears upwardly against a valve retainer member 112 which is secured to the upper end of the stem portion 102 of the valve. A rocker arm member 114 is supported above the upper end of the valve stem 102 and the leftward end thereof specifically bears against the upper end of the stem 102. The rocker arm 114, and specifically its rightward end, pivots about the curved upper surface of the lash adjuster 60 which is mounted in the cylinder head 86 as shown in FIG. 2. The rocker arm 114 is pivoted about its rightward end in a counter-clockwise direction by engagement of a lobe portion of the camshaft 102. The position illustrated of camshaft 102 indicates that more than 180 degrees of clockwise rotation of the cam 102 is required to produce full counter-clockwise pivotal movement of the rocker arm 114 and, consequently, full opening downward movement of the valve stem 102 and head portion 100. In FIG. 2, the camshaft 120 is enclosed by a camshaft cover 122 which is fastened to the cylinder head 86 by means of fasteners 124 (only one of which is shown).

Exhaust is discharged from the combustion chamber through the leftward opening 90 which is normally covered by the enlarged head 126 of the valve. Enlarged head 126 is connected to an elongated stem portion 128 of the intake valve which is reciprocally and slidably mounted within a bore 130 of the valve guide member 132. Member 132 is press fitted within a bore 134 in the cylinder head 86. A coil type spring 136 engages at its upper end a valve retainer member 138 also attached centrally to the upper end of the stem 128 to maintain the stem 128 and enlarged head portion 126 of the valve in the closed position shown in FIG. 2. A rocker arm 140 is supported above the upper end of the valve stem 128 and includes a rightward end 142 engaging the upper end of the valve stem 128. The rocker arm 140 is pivotal about its leftward end which is supported on the curved upper surface of the lash adjuster 60 supported by the cylinder head 86. Rocker arm 140 is pivoted clockwise about the leftward end in FIG. 2 by engagement with a camshaft 146 which rotates in the counter-clockwise direction. In the position shown in FIG. 2, cam 146 must rotate counter-clockwise about 90 degrees to cause the rocker arm 140 to pivot about the leftward end 144 and cause the rightward end 142 to move the stem portion 128 and enlarged head 126 to the open position unblocking the opening 90 to the combustion chamber. This is accomplished by reducing the axial length of the resilient coil spring 136. The camshaft 146 is covered at the upper end by a cam cover 148 which is secured to the cylinder head 86 by means of fastener means 150 (only one of which is shown).

The cylinder head 86 is cooled by a plurality of air and water cooling passages 152, 154 and 156 to prevent overheating of the cylinder head 86. Passage means (not shown) are provided to conduct oil from the valve train chamber back into the crankcase of the engine.

Figure 4:
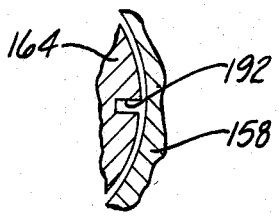
FIG. 4 is a sectioned view of the lash adjuster shown in FIG. 3 taken along section line 4—4 and looking in the direction of the arrow.
Figure 3:
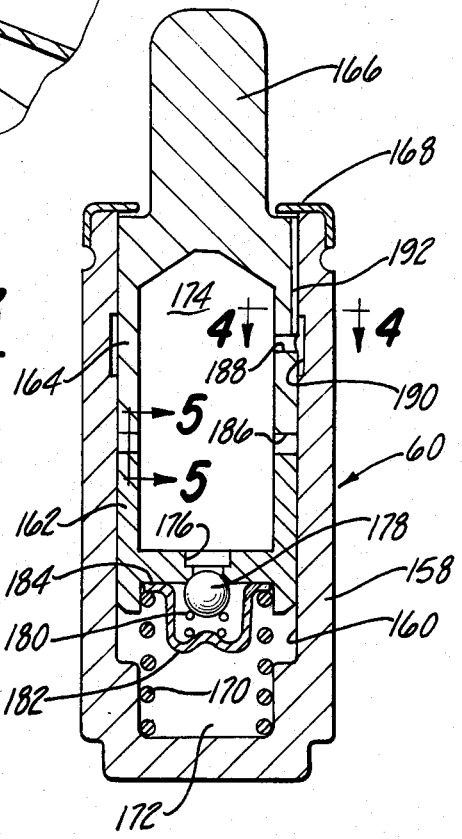
FIG. 3 is an enlarged elevational sectional view of the lash adjuster shown in FIGS. 1 and 2.
Figure 5:
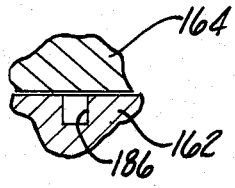
FIG. 5 is a sectioned view of the lash adjuster shown in FIG. 3 taken along section line 5—5 and looking in the direction of the arrow.

Referring specifically to FIGS. 3–5, the components of the subject hydraulic lash adjuster are better illustrated. Specifically, a generally cylindrical housing 158 is provided with an internal cylindrical bore 160. A generally cylindrical power or load supporting plunger 162 is reciprocally mounted within the bore 160. Above the power plunger 162, a reservoir forming plunger 164 is reciprocally supported within the bore 160. The reservoir plunger includes an elongated upwardly directed stud portion 166 with a generally rounded or curved upper surface for engagement with the rocker arm as is shown in FIGS. 1 and 2. Both plungers 162 and 164 are retained within the housing 158 and specifically within the bore 160 by means of a turned over fastener 168 which grips the upper end of the housing 158. The plungers 162 and 164 are biased upward in the bore 160 to the position shown in FIG. 3 by means of a spring 170 which tends to produce a maximum volume compression or power chamber 172 which is defined between the ends of the power plunger and the bottom end of the housing 158. Another chamber 174 is defined within the hollow interior of the reservoir forming plunger 164 and the upper end of the power plunger 162. The chambers 172 and 174 are communicated for flow of fluid only in the downward direction by a passage 176 in the piston or plunger 162. Specifically, a ball shaped valve 178 bears against the opening of passage 176 under the force of a spring 180 to prevent fluid flow from chamber 172 to chamber 174. The spring 180 is retained at its lower end by means of a generally cup shaped spring retainer 182 with a upper peripheral edge captured by the upper end of the spring 170. Spring 180 maintains the valve 178 against the bottom opening of passage 176 and by yieldable compression of the spring 180, oil is permitted to flow from the reservoir chamber 174 to the power chamber 172, but not in the opposite direction. There are openings through the member 182 to complete the communication between chambers 172, 174.

In FIG. 4, the partial sectional view shows the spacing between the reservoir plunger 164 and housing 158. Also illustrated is the shallow channel or groove 192 which extends from the upper portion of the lash adjuster 60 adjacent the retainer 168 to a radially extending opening or passage 188 in the reservoir plunger 164. Surrounding the reservoir plunger where the passage 188 is located, is an annular channel 190 recessed outward from the cylindrical surface 160 of housing 158. The communication formed by the passages 188, 190 and 192 permits the escape of air from the reservoir chamber 174.

In FIG. 5, the partial sectioned view shows the cooperation between the end surfaces of the plungers 162 and 164. It is noted that a groove 186 is provided therebetween the significance of which will be more readily apparent hereinafter. If an axial collapsing force or downward force is placed on the upper reservoir plunger 164, a downward force is transmitted to the power plunger 162 which tends to compress the oil within the power chamber 172. Because oil cannot leave the power chamber 172 through the passage 176 due to the action of ball valve 178, the oil must slowly escape chamber 172 by passage between the cylindrical outer surface of the plunger 162 and the cylindrical surface 160 of the housing 158. The oil then passes upward and through the groove 186 into the reservoir chamber 174. This takes place at a very low flow rate.

The upper reservoir plunger 164 is much more loosely fitted within the cylindrical bore 160 than is plunger 162 and this readily permits air to escape from the reservoir and oil to return to the reservoir as explained hereinafter.

Figure 6:
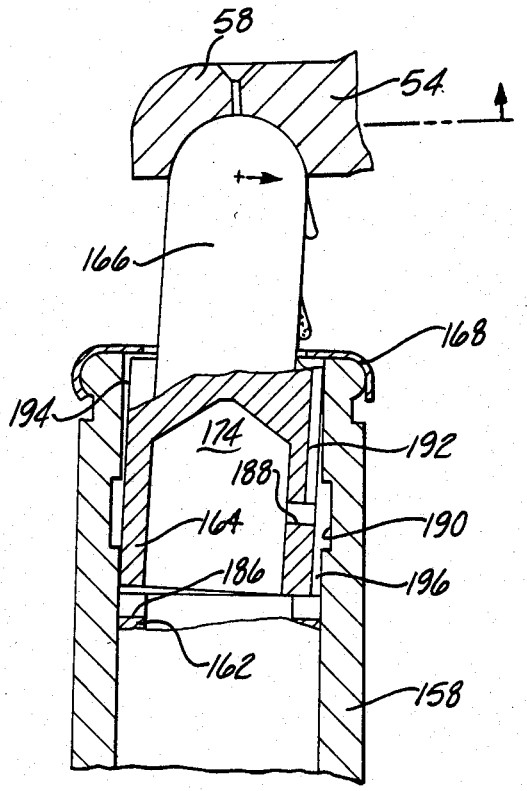
FIGS. 6 and 7 are greatly enlarged and exaggerated views of the operational oscillations of the upper portion of the lash adjuster during operation of the engine which produces the subject pumping action to re-supply the reservoir with oil.
Figure 7:
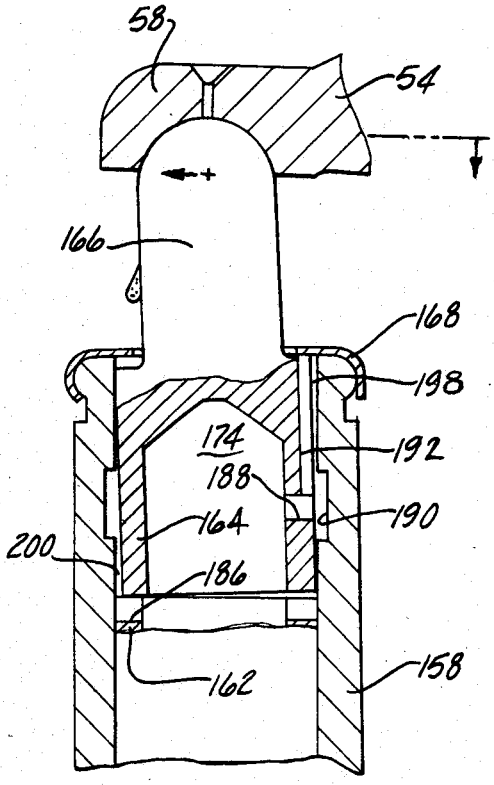

As previously alluded to, the subject lash adjuster is supplied with oil or oil is maintained in the reservoir by means of the run-off of oil which passes over the rocker arm and collects around the upwardly extending boss portion 166. As shown in FIGS. 6 and 7, droplets of oil may pass downward along the outer surface of the boss 166 and then collect beneath the retainer 168. This collected oil is the only source for replenishing the reservoir. Referring back again to FIG. 1, it can be seen that the rocker arm 54 is subjected to substantial downward vertical forces due to the action of the lobe of cam 62. As the rocker arm 54 pivots about its leftward end in FIG. 1 due to the action produced by the cam lobe, the rocker arm 54 assumes an angled position relative to the upper extended boss portion 166 of the lash adjuster 60. Specifically, reference is now made to FIGS. 6 and 7. FIG. 6 represents the angular position of the rightward end 58 of the rocker arm 54 which would be assumed when the rocker arm 54 is in its upward or valve closed operational position (when the cam lobe does not move the rocker arm downward). In FIG. 7, the angular position between the rightward end 58 of the rocker arm 54 and the upwardly projecting boss portion 166 is shown when the cam lobe engages the upper surface of the rocker arm 54 to move the associated valve downward to its valve open position. It should be noted that in the FIGS. 6 and 7, the clearance dimensions are exaggerated somewhat to provide a clearer view of the operational characteristics which occur as the valve is opened and closed.

In FIG. 6, the valve lash adjuster 60 is shown during the period when the associated valve is in a closed position. In this arrangement, the rocker arm 54 is pivoted counter-clockwise to a maximum upward position. This produces a rightward force on end 166 of plunger 164. The force is indicated by the arrow superimposed on the upper portion of the boss 166. In FIG. 7, the downward movement or clockwise pivotal movement of the rocker arm 54 about end 58 produces a leftward force on end 166 of plunger 166 as shown by the arrow superimposed in the upper end of boss 166. The side-to-side forces on the end 166 of plunger 164 produce the alternate cocking or misalignment of member 164 in the bore of housing 158.

The above-described movements of the rocker arm 54 produce the cocking or oscillating movement of the loosely fit reservoir plunger 164 in the bore of the housing as shown in FIGS. 6 and 7. This oscillation occurs at a fairly rapid frequency since the camshaft in a four cylinder engine operates at half crankshaft speed. A typical operating speed of a four cylinder engine may be about 3,000 RPM and therefore the camshaft is rotating at 1,500 RPM. Thus, the reservoir plunger is oscillated 1,500 times a minutes or about 25 times a second. Referring specifically to FIG. 6, the clockwise oscillation or cocking of plunger 164 produces a widened space 194 and 196 between the reservoir plunger 164 and the housing 158 at the upper left and the lower right positions. Referring to FIG. 7, the opposite counter-clockwise oscillation or cocking of the plunger 164 produces a widened space 198 and 200 at the upper right and the lower left. It has been discovered that oil collected about the upper end of the lash adjuster is pumped into the reservoir chamber 174 by this rapid oscillating movement of plunger 164 in the cylinder bore. Whereas previously it was believed that a relatively close fit between the reservoir plunger and the bore was necessary to provide a satisfactorily operating lash adjuster, this application teaches that a more loosely arranged fit between the plunger and the cylinder bore of the housing provides positive pumping of oil collected around the top surface of the lash adjuster which is then pumped into the reservoir chamber 174 by the rapid oscillation or cocking action produced on the reservoir plunger.

In the preferred embodiment of the lash adjuster, it is desirable to fit the lower or power plunger 162 very precisely within the cylinder bore 160. The clearance between the lower power plunger 162 and the bore 160 is 0.00005 inches which is a very precise and high quality sliding fit. The clearance between the reservoir plunger 164 and the cylindrical bore 160 is 0.002 inches which is a much less precise fit than the aforementioned fit. This relative sloppiness allows the reservoir plunger to oscillate in the manner prescribed for pumping of oil into the reservoir.

Although only one embodiment of the subject lash adjuster has been illustrated and described in great detail and in two specific engine applications, it is obvious that modifications thereof can be made which still fall within the scope of the following claims which define the invention.

I claim:

1. In an internal combustion engine with a valve assembly of the type including overhead valves supported by a cylinder head for opening and closing movements in a substantially vertical direction and a rotatable overhead camshaft thereabove lubricated by engine oil pumped by an engine oil pump, a hydraulic lash adjuster with an internal reservoir therein which is solely supplied with run-off lubricating oil from the camshaft which oil is pumped into the internal reservoir of the lash adjuster by self-pumping operation of the lash adjuster produced by lateral forces thereon by the rotative operation of the camshaft comprising:

a housing of the lash adjuster including an axially extending bore therethrough with a lower wall means of the housing closing the lower end thereof;

a first plunger member being closely slidably received in the bore of the housing and having wall means defining a fluid filled power chamber with the lower wall means of the housing;

a second plunger member of the lash adjuster having a portion being loosely slidably received and extending into the bore of the housing for reciprocation therein and another portion extending upwardly from the housing to operatively receive alternating side-to-side force inputs from operation of the camshaft;

the first and second plunger members being hollow and with abutting end surfaces for defining a fluid reservoir means therein;

passage and check valve means through the wall of the first plunger member to permit flow of fluid from the reservoir means to the power chamber but not otherwise;

means including the upper end of the housing to collect a quantity of run-off lubricant from the camshaft;

air vent means communicating the upper portion of the reservoir means with atmosphere;

the first plunger member and the housing being closely fitted together to permit only a minimal flow of fluid from the power chamber between the housing and the second member;

the second plunger member and the housing being relatively loosely fitted together over a significant axial length of the housing bore sufficient to permit sufficient angular cocking of the second member in the bore of the housing relative to the axis thereof and relative to the first member in response to the side-to-side forces thereon produced by the rotating camshaft whereby rapid alteration of this side-to-side cocking causes collected oil at the upper portion of the housing to be pumped into the reservoir between the abutting end surfaces of the first and second members.

2. In an internal combustion engine having an overhead valve assembly including overhead valves supported by a cylinder head in a manner permitting opening and closing movements of the valves in a substantially vertical direction, a rotatable overhead camshaft with at least one lobe thereon lubricated by pressurized engine oil pumped by an engine oil pump and a rocker arm member between each camshaft lobe and each valve to transmit camshaft lobe opening movements to the valve, a hydraulic lash adjuster associated with each rocker arm member and having an internal oil reservoir which is solely supplied with run-off lubricating oil from the camshaft and the associated rocker arm member which oil is transmitted into the reservoir by self-pumping operation of the lash adjuster generated by alternating lateral forces on the lash adjuster by periodic operation of the cam lobe on the rocker arm, comprising:

a housing of the lash adjuster having an axially extending bore and a lower wall means closing the end portion of the housing;

the housing being supported by the cylinder head laterally from the camshaft on an opposite side from an associated valve;

a first plunger member closely slidably received in the bore of the housing and having wall means defining a fluid filled power chamber in association with the lower wall means of the housing;

a second plunger member being loosely slidably received and extending into the bore of the housing to permit reciprocation therein and having another portion extending from the upper end of the housing and terminated in a rounded end support surface thereof;

the associated rocker arm member having a first end portion configured to engage the rounded end support surface of the lash adjuster and being pivotal thereabout, the camshaft engaging the midportion of the rocker arm member and an opposite second end of the rocker arm member engaging the overhead valve to produce opening movement thereof as the lobe of the camshaft slidingly engages the midportion of the rocker arm member whereby when the rocker arm member and the lobe of the camshaft are engaged to open the valve, the rocker arm member is pivoted about the rounded support end of the lash adjuster so as to produce a lateral side-to-side force in one direction on the second plunger member of the lash adjuster and when the rocker arm member and camshaft are engaged to permit the valve to remain closed, the rocker arm member is pivoted so as to exert a lateral side-to-side force in a second opposite direction on the second plunger member of the lash adjuster;

the first and second plunger members being hollow and with abutting end surfaces for defining a fluid reservoir means therein;

passage and check valve means through the wall means of the first plunger member to permit flow from the reservoir means to the power chamber but not otherwise;

means including the upper end of the housing to collect a small quantity of run-off lubricant from the camshaft and associated rocker arm member;

air vent means communicating the upper portion of the reservoir means with atmosphere;

the second plunger member being relatively loosely fitted within the bore of the housing over a significant axial length sufficient to permit significant angular cocking of the second member within the aperture of the housing in response to the alternating lateral forces in the first and second directions produced thereon by pivoting of the rocker arm member caused by periodic engagement with the lobe of the camshaft whereby rapid alterations between the opposite cocked positions of the second plunger member pumps oil collected at the upper portion of the housing into the reservoir between the abutting end surfaces of the first and second plunger members.

3. The self pumping lash adjuster and associated valve system of claim 2 in which the annular clearances between the bore of the housing and the first and second plunger member are about 0.00005 inches and 0.002 inches, respectively.

4. The self pumping lash adjuster and associated valve assembly set forth in claim 2 in which the ratio of the clearance between the second plunger member and the aperture of the housing to the annular clearance of the first member and the aperture of the housing is about 40 to 1.

5. The self pumping lash adjuster and associated valve assembly set forth in claim 2 in which the annular clearance between the second plunger member and the aperture of the housing is about 0.002 inches and vent means are provided from the upper portion of the reservoir by means of a radial aperture through the second plunger member intersected by an axially extending channel in the outer surface thereof.

* * * * *